US009428921B2

(12) United States Patent
Hawk

(10) Patent No.: US 9,428,921 B2
(45) Date of Patent: Aug. 30, 2016

(54) METHOD FOR INSTALLING TRIM SYSTEM WITH A HIDDEN FASTENER

(71) Applicant: Ply Gem Industries, Inc., Cary, NC (US)

(72) Inventor: T. Daniel Hawk, Smithville, MO (US)

(73) Assignee: PLY GEM INDUSTRIES, INC., Cary, NC (US)

( * ) Notice: Subject to any disclaimer, the term of this patent is extended or adjusted under 35 U.S.C. 154(b) by 0 days.

(21) Appl. No.: 14/944,962

(22) Filed: Nov. 18, 2015

(65) Prior Publication Data

US 2016/0069093 A1 Mar. 10, 2016

Related U.S. Application Data

(62) Division of application No. 14/153,837, filed on Jan. 13, 2014, now Pat. No. 9,194,173.

(51) Int. Cl.

| | |
|---|---|
| ***E04F 19/02*** | (2006.01) |
| ***E06B 3/964*** | (2006.01) |
| ***E06B 3/968*** | (2006.01) |
| ***E04F 19/04*** | (2006.01) |
| ***E06B 1/34*** | (2006.01) |
| ***E06B 1/68*** | (2006.01) |
| ***E04F 13/24*** | (2006.01) |
| ***E06B 1/62*** | (2006.01) |
| ***E06B 3/30*** | (2006.01) |

(52) U.S. Cl.

CPC ..... *E04F 19/02* (2013.01); *E04F 13/24* (2013.01); *E04F 19/0463* (2013.01); *E06B 1/34* (2013.01); *E06B 1/62* (2013.01); *E06B 1/68* (2013.01); *E06B 3/30* (2013.01); *E06B 3/9645* (2013.01); *E06B 3/9682* (2013.01)

(58) Field of Classification Search

CPC ..... E04F 19/02; E04F 13/24; E04F 19/0463; E06B 1/34; E06B 1/62; E06B 3/30; E06B 1/68; E06B 3/9645; E06B 3/9682

See application file for complete search history.

(56) References Cited

U.S. PATENT DOCUMENTS

| | | | |
|---|---|---|---|
| 1,150,790 | A | 8/1915 | Swanson |
| 3,139,703 | A | 7/1964 | Hilt |
| 3,757,483 | A | 9/1973 | Torbett |
| 3,778,945 | A | 12/1973 | Medow |
| 4,193,238 | A | 3/1980 | Chalmers et al. |
| 4,389,824 | A | 6/1983 | Anderson |
| 4,423,575 | A | 1/1984 | Lagergren et al. |
| 4,825,617 | A | 5/1989 | Kinoshita et al. |

(Continued)

OTHER PUBLICATIONS

CertainTeed, "Restoration Millwork," Jan. 2014, 24 pages.

*Primary Examiner* — James Ference
(74) *Attorney, Agent, or Firm* — Lathrop & Gage LLP

(57) ABSTRACT

A method for installing and securing a trim system adjacent an edge of a building penetration, the trim system including at least one bracket that is attachable to a wall. The bracket having a center channel having opposed first and second side walls, at least one locking wedge located along each opposed side wall, and at least one tab extending outwardly from a side wall for gauging bracket distance from the edge of the penetration. The trim system also including at least one trim piece that is attachable to the bracket, the trim including at least two longitudinally extending slots disposed within the hidden surface of the trim for receiving the at least one locking wedge located along each opposed side wall of the bracket.

20 Claims, 8 Drawing Sheets

(56) References Cited

U.S. PATENT DOCUMENTS

| | | | |
|---|---|---|---|
| 4,840,002 | A | 6/1989 | Lovgren |
| 5,022,204 | A | 6/1991 | Anderson |
| 5,090,174 | A | 2/1992 | Fragale |
| 5,526,619 | A | 6/1996 | Vagedes |
| 5,581,970 | A | 12/1996 | O'Shea |
| 5,625,992 | A | 5/1997 | Strick et al. |
| 5,678,367 | A | 10/1997 | Kline |
| 5,787,660 | A | 8/1998 | Adams |
| 5,850,717 | A | 12/1998 | Schiedegger et al. |
| 5,916,077 | A | 6/1999 | Tang |
| 5,937,600 | A | 8/1999 | Larson |
| 6,112,481 | A | 9/2000 | Schiedegger et al. |
| 6,148,584 | A | 11/2000 | Wilson |
| 6,155,011 | A | 12/2000 | Robertson |
| 6,219,980 | B1 | 4/2001 | Peck, Jr. |
| 6,272,797 | B1 | 8/2001 | Finger |
| 6,276,101 | B1 | 8/2001 | Schiedegger et al. |
| 6,287,046 | B1 | 9/2001 | Neuhofer, Jr. |
| 6,295,779 | B1 | 10/2001 | Canfield |
| 6,393,779 | B1 | 5/2002 | Boldt |
| 6,482,500 | B1 | 11/2002 | Diginosa |
| 6,560,944 | B1 | 5/2003 | Wilson |
| 6,745,523 | B2 | 6/2004 | Petta |
| 6,837,020 | B1 | 1/2005 | Keddell |
| 6,857,232 | B2 | 2/2005 | Bealko |
| 6,988,345 | B1 | 1/2006 | Pelfrey et al. |
| 7,228,663 | B2 | 6/2007 | Schiedegger et al. |
| 7,284,353 | B2 | 10/2007 | Bealko |
| 8,104,241 | B2 | 1/2012 | Andres |
| 2002/0059760 | A1 | 5/2002 | Heard et al. |
| 2003/0121226 | A1 | 7/2003 | Bolduc |
| 2003/0145538 | A1 | 8/2003 | Kerscher |
| 2005/0262798 | A1 | 12/2005 | Pringle et al. |
| 2006/0096203 | A1 | 5/2006 | Weinstein |
| 2006/0207197 | A1 | 9/2006 | Anderson |
| 2006/0260247 | A1 | 11/2006 | Monteer |
| 2007/0068098 | A1 | 3/2007 | de Briere et al. |
| 2007/0094958 | A1 | 5/2007 | Rogers |
| 2008/0148672 | A1 | 6/2008 | Monteer |
| 2009/0013636 | A1 | 1/2009 | Wilson |
| 2009/0049780 | A1 | 2/2009 | Pulte et al. |
| 2010/0088987 | A1 | 4/2010 | Monteer |
| 2011/0005153 | A1 | 1/2011 | Schield |
| 2011/0179733 | A1 | 7/2011 | Picken |
| 2012/0222383 | A1 | 9/2012 | Cashman |
| 2012/0328823 | A1 | 12/2012 | Monteer |
| 2013/0047532 | A1 | 2/2013 | Armacost |
| 2013/0305640 | A1 | 11/2013 | Cashman |

METHOD FOR INSTALLING TRIM SYSTEM WITH A HIDDEN FASTENER

RELATED APPLICATION

This application is a divisional application of U.S. patent application Ser. No. 14/153,837 filed Jan. 13, 2014 the disclosures of which are incorporated by reference.

FIELD OF THE INVENTION

This invention relates to methods for securing trim to a building penetration with a system of brackets that are hidden from view and that obviate the need for cleanup of fastener holes.

BACKGROUND

In the conventional manner of applying trim, for example, around a window penetration in a house, the carpenter cuts the lengths of trim, mitres the corners, and then nails the lengths of trim in place. Next the nails are driven below the surface of the trim and filler is applied into the indentations. This material then sets in place. The carpenter then returns later, and levels the filler. After that he applies stain, a sealant, and any other finishing touches as required. This difficult process is made more difficult by the fact that walls, floors, ceilings and door and window frames are seldom flat, straight and square.

The invention is aimed at providing a method for attaching trim around a building penetration which is far simpler for the carpenter than the above, and in which nothing (such as nail heads) mars the presentation-surface of the trim. It is an aim of the invention that the trim may be pre-finished, in-factory if desired, and applied to the wall in its finished form.

An object of the present invention is to provide a method for installing a window frame and other building trim in a manner that does not require driving attachment hardware through the front face of the trim.

For the foregoing reasons, there is a need for a method of of installing trim using a hidden bracket system that does not require the use of any exposed fasters to secure the trim to the building.

SUMMARY

An object of the present invention is to provide a method of installing window frame and other building trim which can be attached to the wall, generally before siding or the like is secured to the wall, in a manner that does not require driving attachment hardware through the front face of the trim. There may; however, be circumstances where the trim is applied after the siding has been pre-fit to its designated coverage area.

In one aspect, the disclosure is directed to a trim and bracket combination for attachment around a building penetration wherein the bracket may include at least two tabs extending outwardly from one of the side walls of the bracket to facilitate offsetting the bracket from the edge of the penetration and to orient it parallel with the edge of the penetration.

It is evident from the background that the disclosure applies to a variety of building penetrations. Thus, a frame may be assembled from the multiple cut trim segments or a partially or totally prefabricated frame may be secured to the wall surrounding a wall penetration without attaching or driving any hardware into or on the frame itself.

For use with certain siding types including vinyl siding, a siding undercut may be provided along one side of the trim board whereby the side edges of siding elements can be slid laterally into the siding undercut.

This disclosure is directed to a method of installing trim having a front face, a back face and opposite side faces, comprising the steps of aligning the bracket with the edge of the building feature or penetration with the aid of attached frangible tabs with striations; affixing the aligned bracket to a wall and then manually engaging the bracket locking wedges in the two longitudinally extending slots on the rear surface of the trim.

From another aspect, the disclosure is directed to a building penetration comprising, top, bottom and opposed side frame elements connected together to define a rectangular frame.

Various objects, features, aspects and advantages of the inventive subject matter will become more apparent from the following detailed description of preferred embodiments, along with the accompanying drawings in which like numerals represent like components.

DETAILED DESCRIPTION

Figure 1:
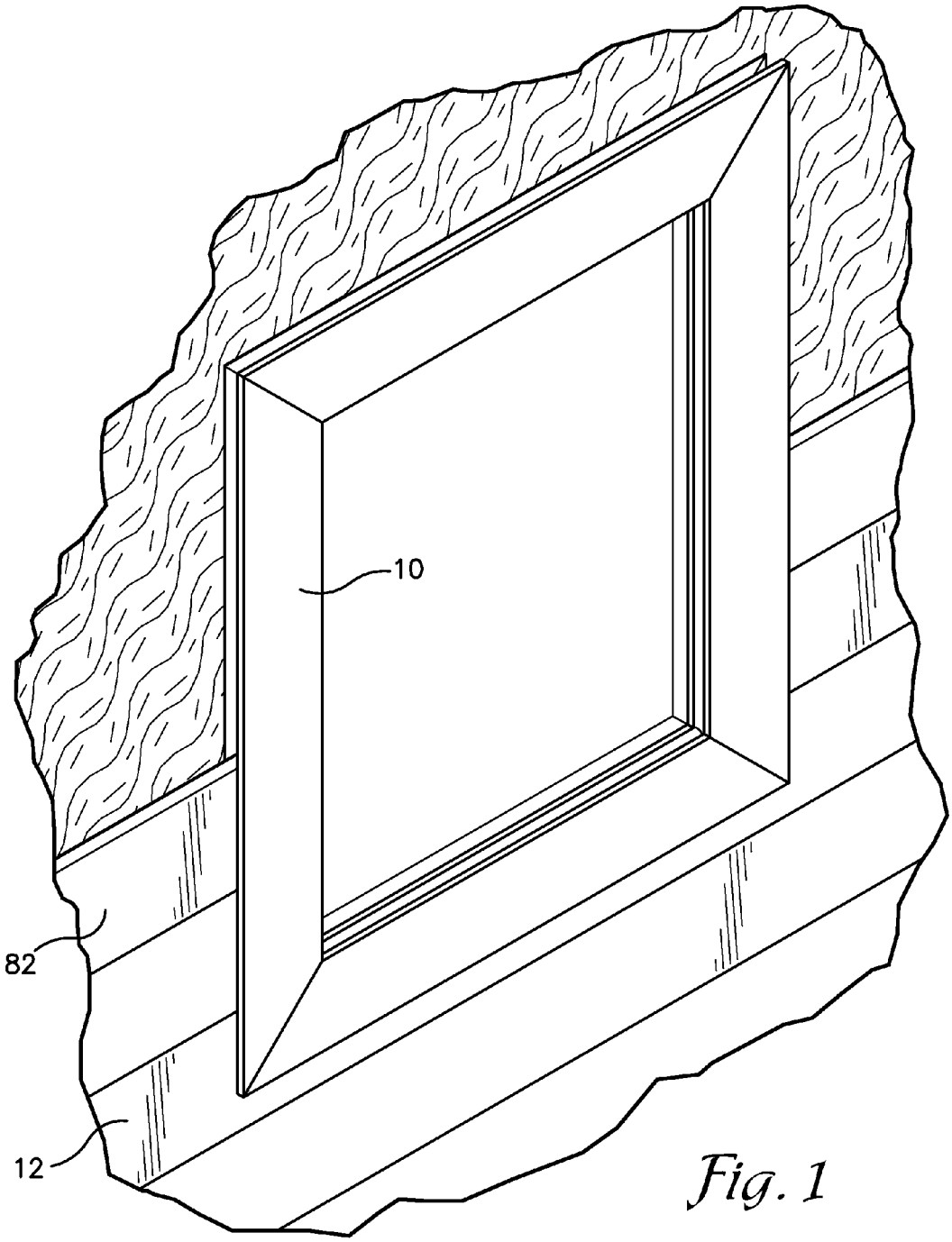
FIG. 1 is a perspective view of an embodiment of a trim system intersecting at a 45 degree angle with hidden brackets detailing the placement of the siding proximate the trim.
Figure 2:
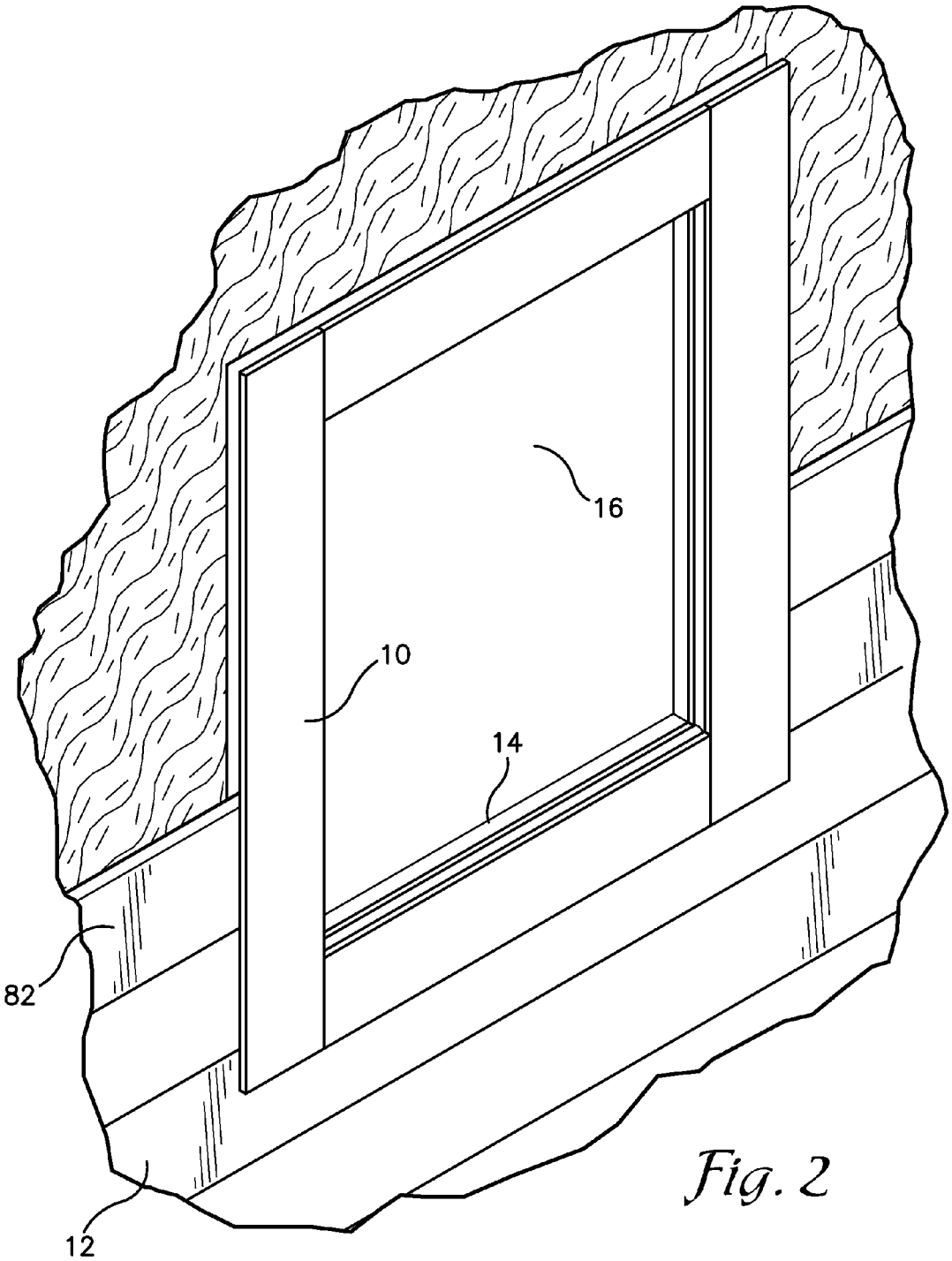
FIG. 2 is a perspective view of an embodiment of a trim system intersecting at a 90 degree angle with hidden brackets detailing the placement of the siding proximate the trim.

Referring first to FIGS. 1 and 2, which reveal a building 12 penetration 14, in this instance a window 16, surrounded by multiple sections of decorative trim 10 that frame the window and provide an aesthetically pleasing appearance. FIG. 1 depicts a window trim configuration with the corner cuts at 45 degrees to the adjacent trim piece while FIG. 2 depicts a window trim configuration with the adjacent trim pieces at 90 degrees to one another. In addition to the trim 10 framing a window 16, it is well known in the art that trim 10 may be used to surround a door (not shown) to also provide a pleasing appearance, and as with a window, to restrict access of exterior air to the interior of the building as well as to prevent access to the building interior by wind driven rain, sleet and snow. The trim 10 serves not only an aesthetic role but also a functional role by serving as a barrier between the interior and the exterior of the building and by covering small gaps between structural elements to prevent the infiltration of wind and moisture.

Figure 3:
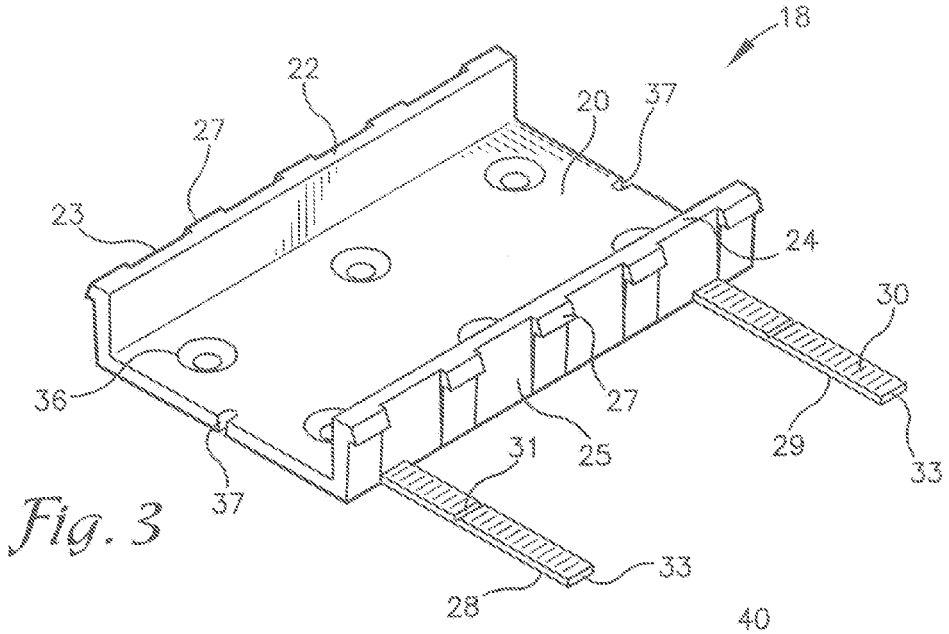
FIG. 3 is a perspective view of an embodiment of a straight bracket detailing the measurement tabs.

FIG. 3 details a preferred embodiment of the bracket 18 used to secure the trim 10 to the building 12 proximate the penetration 14. Typically a plurality of brackets 18 will be utilized to secure multiple trim pieces 10 to the building proximate the penetration 14. The bracket 18 includes a center channel 20 having at least an opposed first and second side wall 22, 24. The bracket may also include more than two side walls, for example a bracket may include three or more sidewalls to increase the locking strength between the bracket and the installed trim. The opposed side walls 22, 24 include at least one locking wedge 27 located on the exterior surface 23, 25 of each opposed side wall 22, 24. The brackets 18 also utilize at least one, and preferably two, tabs 28, 29 extending outwardly from a side wall 24. The tabs 28, 29 extend outwardly from the side wall 24 of the bracket 18 that is facing the building penetration and are flush with the bottom surface of the bracket.

The bracket 18 must be offset from the building penetration, or more precisely the edge of the door/window unit being installed, by a predetermined distance depending upon the width of the trim that is being utilized to frame the building penetration. Trim pieces typically utilized in the construction industry are either nominally 4 inch or 6 inches in width. The wider 6 inch trim piece 10 will require a more substantial offset distance from the building penetration 14 and conversely the narrower 4 inch trim piece 10 will require a lesser offset distance from the penetration.

If a 4 inch trim piece is installed then the installer will sever the tabs 28, 29 at the fracture lines 31 leaving tabs of approximately 9/16 of an inch extending outwardly from the exterior surface 25. The shortened tabs are now utilized to gauge the distance the bracket is offset from the edge of the window, or door unit, being installed by placing the fractured end of the tab against the window frame and then securing the bracket to the wall. If the larger nominal 6 inch trim is being installed then the installer does not sever the tab at the fracture line 31 but places the outer edge 33 of the tab against the window frame. This provides the preferred offset distance for 6 inch trim installations. Should a slightly greater or lesser offset on the brackets be desired, for example in order to cover an unsightly weld bead on the window frame, the tabs 28, 29 preferably include a plurality of striations, or markers 30, that allow the installer to uniformly sever the tabs at a desired length in order to offset the bracket 18 away from the building penetration a uniform distance. All the installer need do is to count the striations back from the tip 33 and consistently cut both tabs 28, 29 at the desired striation. The revised tab length can then be used to offset the bracket the desired distance from the edge of the window unit.

If for some reason the installer elects to not utilize the tabs 28, 29 for offsetting purposes, the bracket 18 also includes integral end notches 37 that can be positioned over a chalk line that establishes the preferred location and alignment of the bracket. Once properly positioned against the building structure by either the employment of the tabs 28, 29 or the end notches 37 the bracket 18 is secured to the building with the use of fasteners, such as nails or screws. Depending upon the thickness and density of the bracket material the fasteners may pass through the bracket or through the holes 36 in the bracket.

Figure 4:
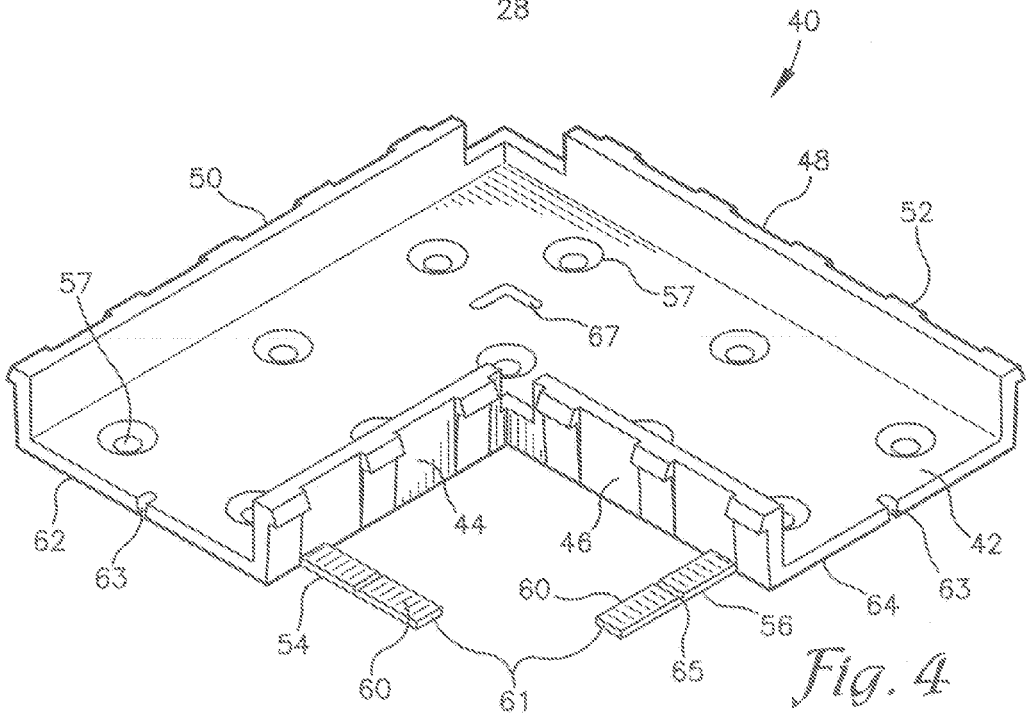
FIG. 4 is a perspective view of an embodiment of a corner bracket detailing the measurement tabs.

FIG. 4 depicts a bracket for intersecting trim parts 40 that optionally may be employed at the corners of the building penetration 14 to produce a precise 45 degree mating surface between the trim pieces 10 as shown in FIG. 2. The intersecting trim part bracket 40 depicted in FIG. 4 utilizes the same structural features as the bracket utilized in FIG. 3 including a center channel 42 having opposed first and second side walls 44, 46, 48, 50. The opposed side walls include at least one locking wedge 52 located along each of side walls 44, 46, 48, 50. The intersecting trim part brackets 40 also utilize at least one tab 54, 56 extending outwardly from each interior side wall 44, 46. As seen in FIG. 4, the tabs 54, 56 extend outwardly from the side walls 44, 46 of the bracket 40 that are facing the building penetration 14.

As with the side bracket depicted in FIG. 3, when installing a 6 inch trim piece the tabs 54, 56 are utilized as provided from the manufacturer. The ends 61 of the tabs 54, 56 are placed against the edge of the window frame or door unit being installed and then the bracket is secured in position by passing fasteners through the holes 57 in the center channel 42. If instead, nominal 4 inch trim is being applied adjacent the penetration then the installer will sever the tabs 54, 56 at the fracture lines 65. Severing the tabs 54, 56 at the fracture lines 65 removes nominally one inch of tab length and brings the bracket one inch closer to the edge of the window or door unit being installed. If it is desired to position the intersecting trim part bracket 40 either marginally farther away from or closer to the edge of the window frame than is afforded by the use of the tab trimmed at the fracture line 65, then as with the embodiment depicted in FIG. 3, the installer may elect to trim the tabs 54, 56 at any of the striations or markers 60. As long as the installer severs both tabs at the same striation then the trim will be equidistantly displaced from the window unit. Should the installer prefer to not utilize the disclosed tabs 54, 56 to distance the trim from the penetration she may alternatively employ the end notches 63 to overlay a chalk line set down adjacent the penetration for alignment of the brackets 40. The bracket further provides an opening 67 in the center channel to further facilitate the alignment of the chalk lines.

Once the installer has determined the appropriate offset distance and verified the actual offset of the intersecting trim part bracket 40 using the integral tabs 54, 56 the bracket 40 is secured to the building with the use of fasteners, such as nails or screws. The fasteners, preferably countersunk screws (not shown), are passed through holes 57, preferably conical in cross section, located in the center channel 42.

Figure 5:
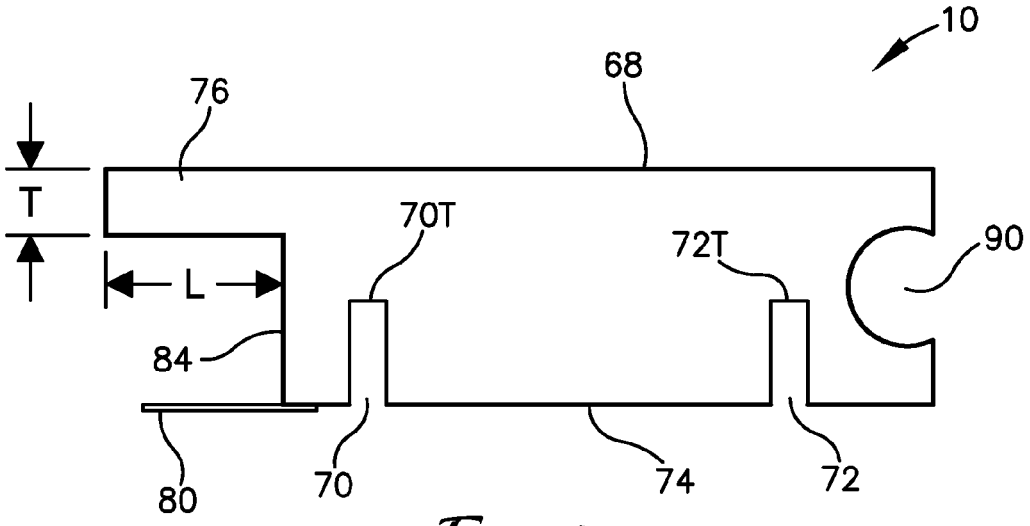
FIG. 5 is a cross-sectional view of an embodiment of a trim piece for use with a hidden bracket system.
Figure 7:
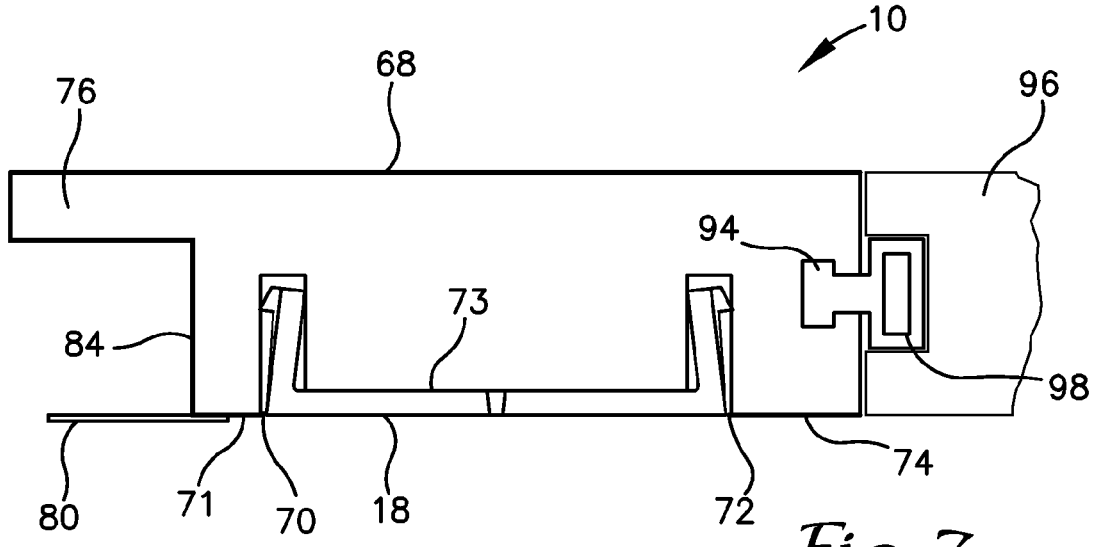
FIG. 7 is a cross-sectional view of an alternative embodiment of a trim piece for use with a hidden bracket system.

FIG. 5 depicts a cross section of the trim piece 10 that is to be mounted to the bracket 18. The trim 10 is preferably fabricated from an engineered plastic, such as cellular polyvinyl chloride (PVC), in sections of a standardized length and two different widths (nominally 4 and 6 inches as previously discussed) but preferably in a variety of surface textures to accommodate a wide range of consumer tastes. The upper surface 68 may be textured, flat or ornamental as options for the consumer. The trim piece 10 includes at least two slots 70, 72 running longitudinally along the trim piece and separating the lower hidden surface into three separate faces 71, 73 and 74. The slots 70, 72 are preferably chamfered at the outside corner of the slot thereby facilitating easier entry of the sidewalls into the slot and passage of the sidewalls to the top of the slots 70T, 72T for receiving the locking wedge 27 as best seen in FIG. 7. The preferred chamfer of the slots 70, 72 is in the range of from 20 to 40 degrees for each exterior corner of the sidewall.

The locking wedge 27 extends outwardly from the side wall. When the locking wedges 27 are inserted into the slots 70, 72 the locking wedges 27 are pushed inwardly and when fully inserted into the slots the wedge bites into the wall of the slot securing the trim piece 10 in position atop the bracket 18. Once the flanges 27 snap into position in the slots 70, 72 they are secured into position and the trim piece 10 cannot readily be removed from the bracket 18.

Figure 5A:
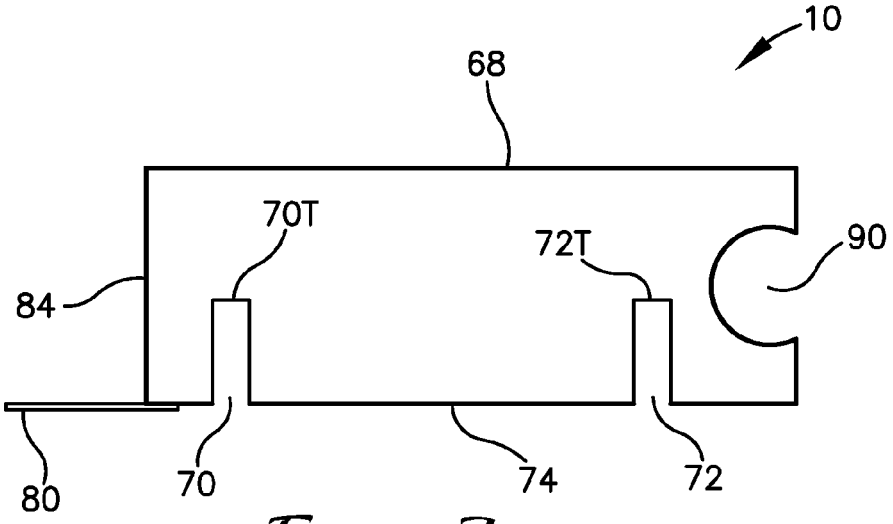
FIG. 5A is a cross-sectional view of an embodiment of a trim piece for use with a hidden bracket system.

In a first embodiment shown in FIG. 5, the trim piece 10 includes an overhang 76 found on the side opposite the side facing the building penetration 14. The overhang 76 preferably extends outwardly a distance 'L' from the upper surface 68 of the trim piece 10 in the range of from 0.75 to 1 inch thereby producing an undercut feature on the trim piece. The thickness 'T' of the overhang 76 may also vary but is preferably in the range of from 0.20 to 0.40 inches. The trim piece 10 shown in FIG. 5 is utilized with siding 82, as best seen in FIGS. 1 and 2, the siding will terminate as close as possible to the wall 84 (see FIG. 5) under the overhang to provide a neat and orderly appearance to the termination of the siding at the window trim. Any uneven end cuts to the siding (not shown) will be obscured by the overhang 76. FIG. 5A depicts an alternative embodiment to the trim piece 10. This embodiment does not include an overhang and is used for those applications employing, for example, James Hardie® Siding Products that end flush against the trim piece at the wall 84.

On the same side of the trim piece as the overhang 76 in FIG. 5 and on FIG. 5A without the overhang, but extending outwardly from the lower or hidden face 74, is an optional weather strip 80. The optional weather strip 80 extends approximately the same distance outwardly from the lower surface 74 as the overhang 76. The weather strip is flexible and serves as a barrier to the entry of moisture into the building around the window 16. As previously noted, the siding preferably terminates as close as possible to wall 84 thereby giving the weather strip 80 the maximum possible coverage of the vertical edge of the siding 82. The weather strip 80 is preferably secured to the hidden face 74 of the trim with adhesive but alternative means of securing may also be employed that are well known in the art.

Figure 6:
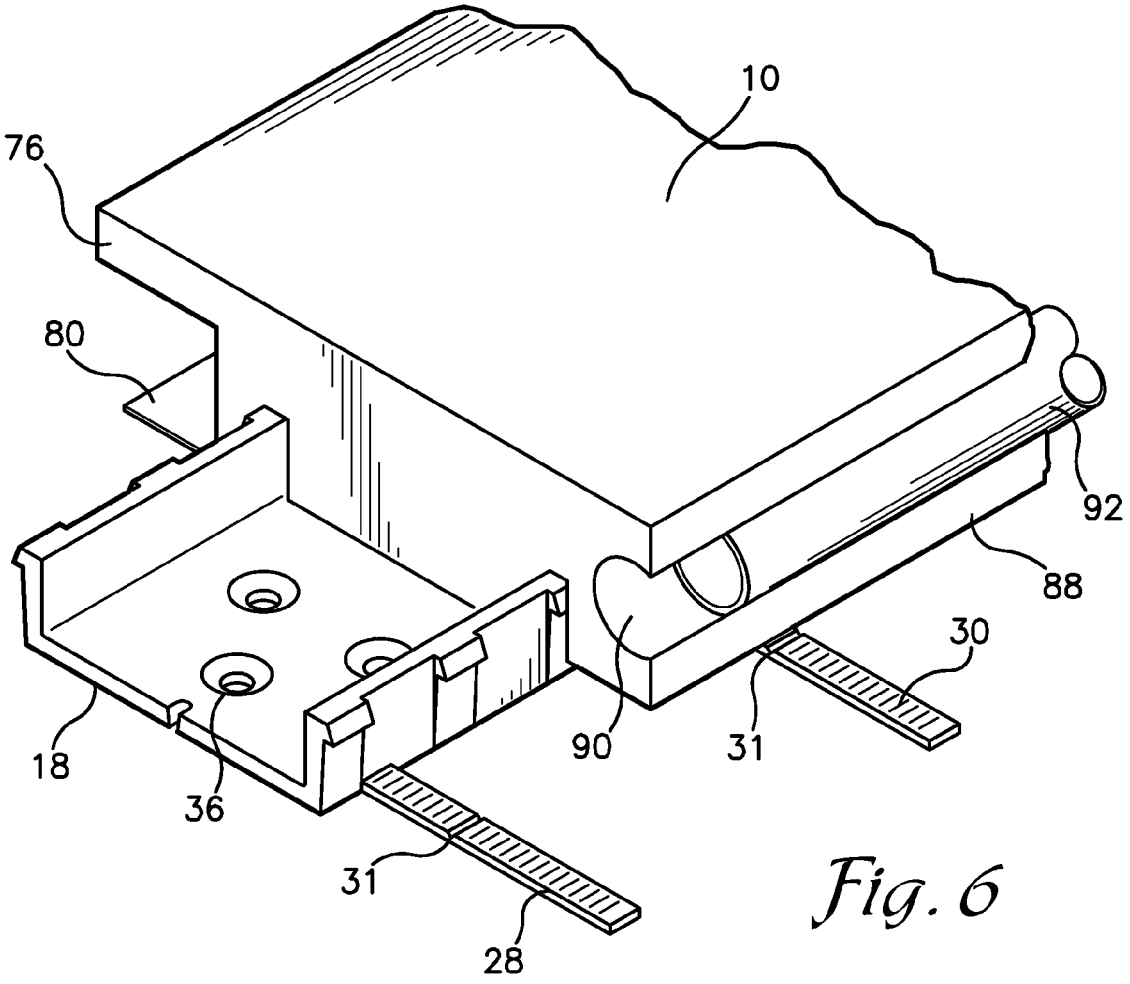
FIG. 6 is a perspective view of an embodiment of the hidden bracket system showing the engagement of the bracket and trim piece.

As depicted in FIG. 6, the side 88 of the trim piece 10 located proximate the building penetration 14 also employs a cutout 90 to retain a compressible seal 92. Once the window (window casing) 16 and the bracket 18 are installed the trim 10 is snapped into position onto the bracket 18. The compressible seal 92 fills the narrow void between the window casing and the side 88 of the trim piece 10 and further prevents the infiltration of air and water to the interior of the structure. The compressible seal 92 may be of any number of cross sectional configurations with exemplary configurations shown in FIGS. 5 and 7, and may be secured to the trim piece in an equally diverse number of ways. For example, FIG. 7 reveals a T-shaped cross section 94 for holding the compressible seal in position. In addition, the compressible seal 96 shown in FIG. 7 is square in cross section with a rectangular retaining element 98 while the compressible seal 92 depicted in FIG. 6 is circular in cross section.

FIG. 7 further reveals an end view of a trim piece 10 snapped into position atop a bracket 18. FIG. 7 details how surfaces 71 and 74 extend below surface 73 by the approximate thickness of the bracket 18 center channel 20. The elevated surface 73 accommodates the bracket center channel 20 into a relieved area thereby allowing the trim 10 lower face surfaces 71, 74 to be in contact with the surface of the structure. Contact between the lower faces 71, 74 and the surface of the building further reduces the prospect of water infiltration into the structure that originates at the far edge of the trim and migrates under the trim piece and through gaps or voids into the building penetration.

Figure 8:
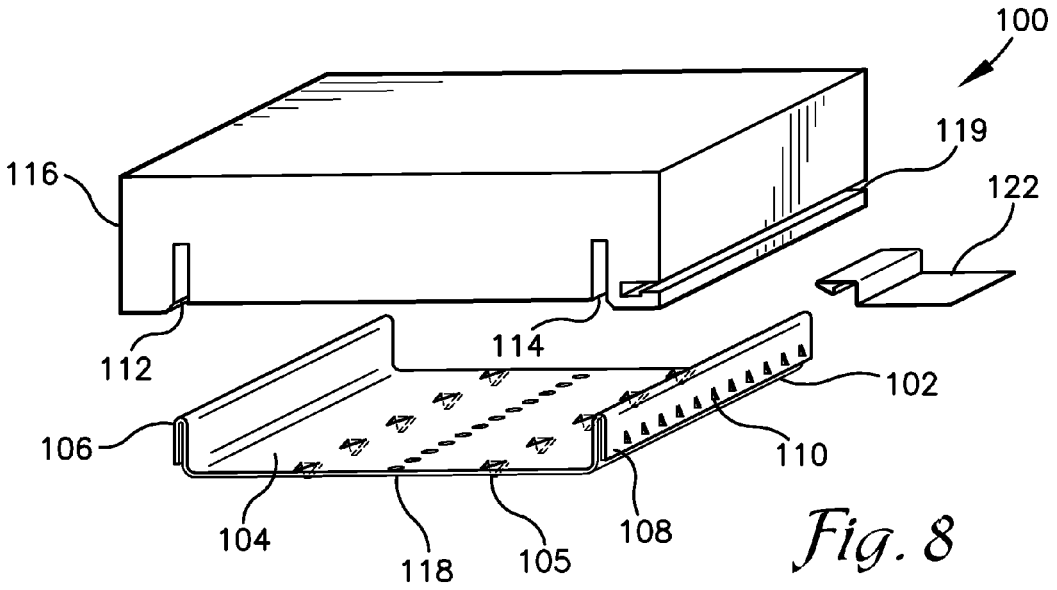
FIG. 8 is an exploded assembly view of an alternative embodiment of a hidden bracket trim system.

FIG. 8 depicts an alternative embodiment of the trim system 100 with a hidden bracket 102. The bracket 102 includes a center channel 104 and two opposed side walls 106, 108. The bracket 102 is preferably fabricated from a ductile galvanized metal capable of forming side walls 106, 108 without fracturing. The side walls 106, 108 preferably include outwardly extending punches of dislodged metal 110 that dig into the slots 112, 114 of the trim piece 116. The center channel 104 includes a plurality of punched holes 118 extending the length of the bracket to secure the bracket 102 to the building with fasteners.

The center channel 104 may also optionally include a plurality of downwardly extending punched metal projections 105 that may be employed to dig into the wall of the structure prior to installation of the fasteners. The purpose of these projections 105 being to allow the installer to quickly press the bracket 102 by hand or with a tool such as a hammer and drive the metal projections 105 into the wall thereby temporarily securing it in position freeing the hands of the installer to gather a powered screwdriver or other tools to more securely fasten the bracket 102 to the wall. The closely spaced holes 118 in the bracket 102 center channel 104 also allow the installer to view a chalk line laid down proximate the building penetration and to verify the location of the chalk line by looking through the holes 118. Once the bracket is lined-up with the chalk line the installer passes fasteners, typically screws or nails, through the holes 118 and into the building.

Once the bracket 102 is securely in position the base trim piece 116 is positioned atop the bracket and snapped into place by aligning the longitudinally extending slots 112, 114 in the trim piece 102 with the walls 106, 108 of the bracket. The longitudinally extending slots 112, 114 may optionally include a chamfer at the bottom of the outside wall of the slot to accommodate easy installation of the walls 106, 108 into the slots. Once the base trim piece 116 is pushed down onto the bracket 102 the punched dislodged metal 110 digs into the engineered plastic of the base trim piece 116 thereby limiting the prospect of backing the base trim piece off of the bracket 102. Once installed the base trim piece 116 cannot longitudinally translate along the bracket as the punched metal 110 of the bracket 102 locks the base trim piece 116 into position.

As shown in FIG. 8 the base trim piece 116 also includes a slot 119 on the side of the trim 120 opposite the building penetration. The slot 119 is utilized to retain a vinyl or metal flashing flange 122 the function of which is placement beneath the siding (not shown) that abuts the trim. The flashing flange 122 serves to prevent intrusion of water beneath the ends of the siding as the siding abuts the trim piece 116.

Figure 8A:
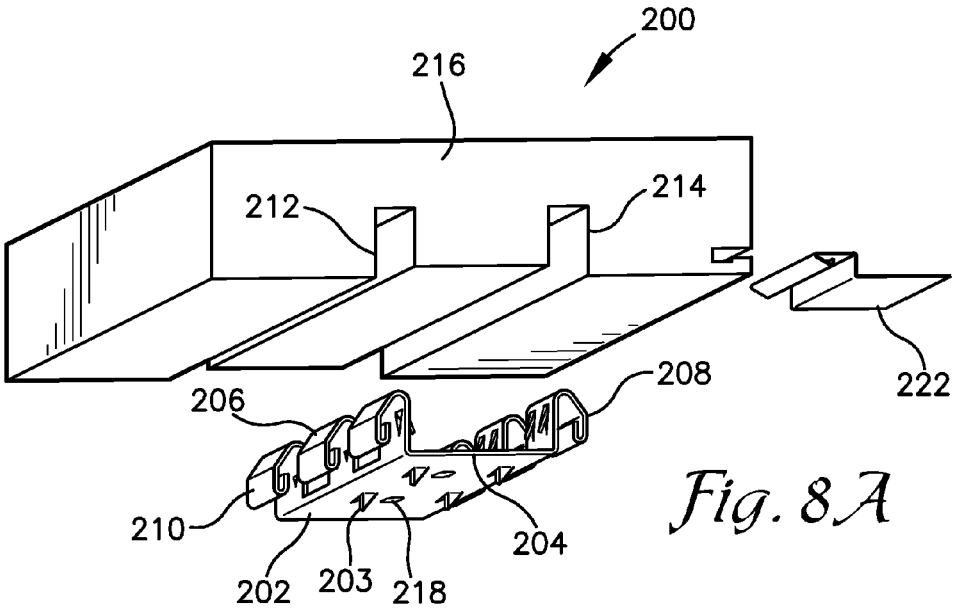
FIG. 8A is an exploded assembly view of an alternative embodiment of a hidden bracket trim system.

FIG. 8A depicts another embodiment of the trim system 200 with a hidden fastener. The bracket 202 includes a center channel 204 and two opposed side walls 206, 208. The bracket 202 is preferably fabricated from a ductile galvanized metal capable of forming side walls 206, 208 without fracturing. The side walls 206, 208 preferably include outwardly extending flanges 210 that dig into the sidewalls of the slots 212, 214 of the trim piece 216. The slots 212, 214 may optionally include a chamfer at the bottom to facilitate easy insertion of the sidewalls 206, 208 into the slots. The center channel 204 includes a plurality of pre-punched holes 218 extending the length of the bracket to secure the bracket 202 to the building with fasteners. The closely spaced holes 218 also allow the installer to view a chalk line laid down proximate the building penetration and to verify the location of the chalk line by looking through the holes. Once the bracket holes are lined-up with the chalk line the installer passes fasteners, typically screws or nails, through the holes into the building. As with the embodiment detailed at FIG. 8, the embodiment depicted at FIG. 8A, may also optionally include small downwardly extending metal punch elements 203 that can be driven into the wall of the structure, for example by hand pressure or with a hammer, to assist in momentarily positioning the bracket prior to the insertion of the fasteners.

Once the bracket 202 is securely in position the base trim piece 216 is positioned atop the bracket and snapped into place by aligning the longitudinally extending slots 212, 214 in the trim piece 202 with the walls 206, 208 of the bracket. Once the base trim piece 216 is pushed down onto the bracket 202 the outwardly extending flanges 210 press firmly against the engineered plastic of the walls of the slots 212, 214. With this configuration, longitudinal translation of the trim piece 216 along the bracket 202 will typically not be possible and is dependent upon how deeply the outwardly extending flanges 210 penetrate the walls of the slots 212, 214.

Figure 9:
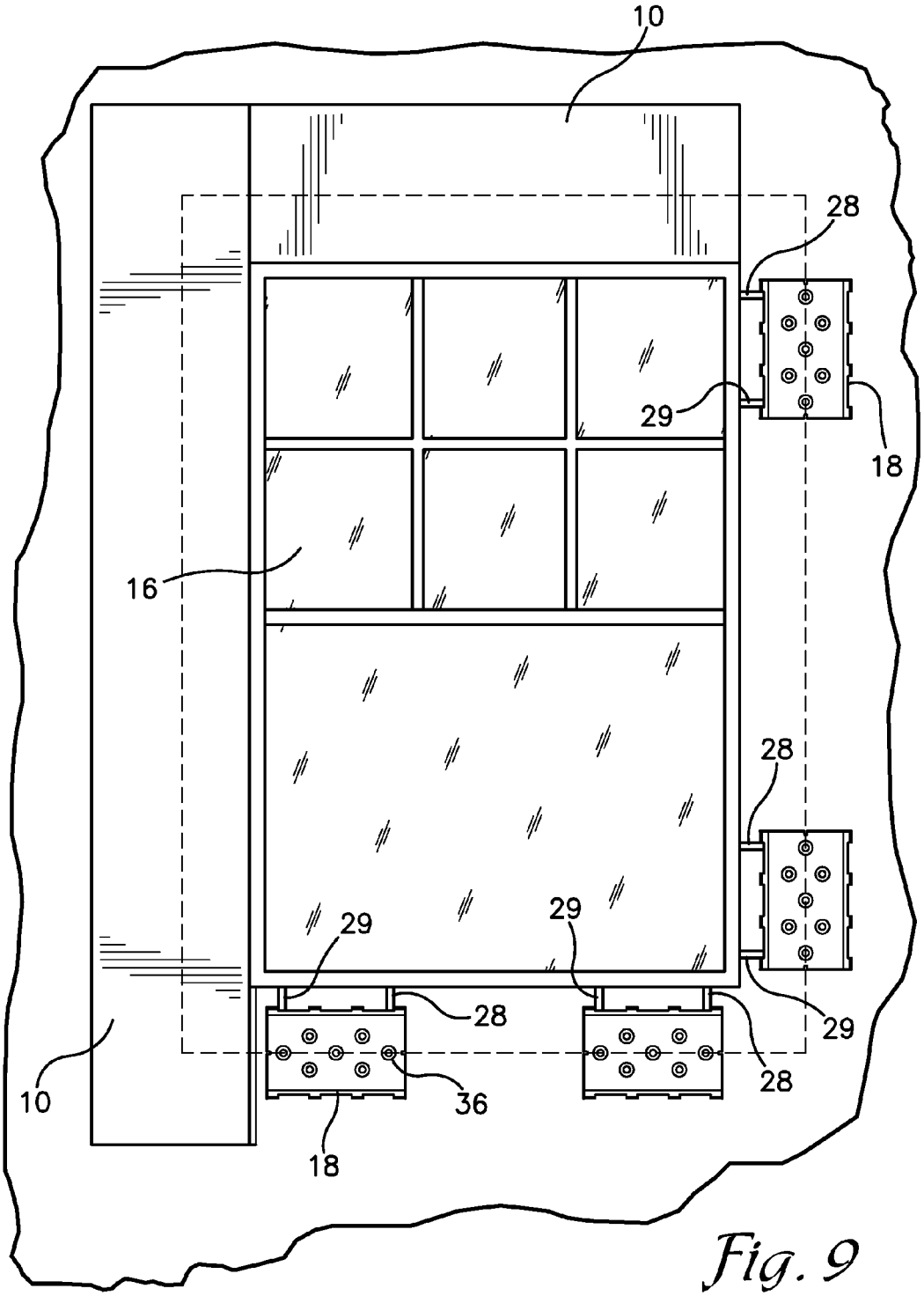
FIG. 9 is a view of the methodology for installing the hidden brackets and the trim pieces.

For purposes of installation/operation and referring to FIG. 9, the tabs 28, 29 of the brackets 18 of the first embodiment are positioned proximate the frame of the window 16 and the tabs facilitate the proper offset from the window frame positioned within the building penetration for the desired trim width (either 4 or 6 inch nominal). Once the window offset has been completed through the use of either the full length of the tab, a tab severed at the fracture line 31 or the use of the striations or markers 30 on the two tabs 28, 29 the bracket 18 is secured to the building using the preferred fasteners. Once the brackets 18 are in position, and preferably spaced approximately 18 inches apart the trim is located over the brackets and snapped into position. Because as previously discussed, it is unlikely that longitudinal translation of the trim will be possible because of the "bite" of the locking wedge 27, the outwardly extending punches of dislodged metal 110 or the outwardly extending flanges 210 that are utilized by the various embodiments of the brackets 18, 104, 202. Consequently, the installer must take care to position the trim onto the bracket with a measure of locational precision as the trim can only be longitudinally translated a very nominal distance before it is permanently locked into position because of the deep penetration of the locking members 27, 110, 210 into the sidewalls of the slots of the trim pieces.

Figure 10:
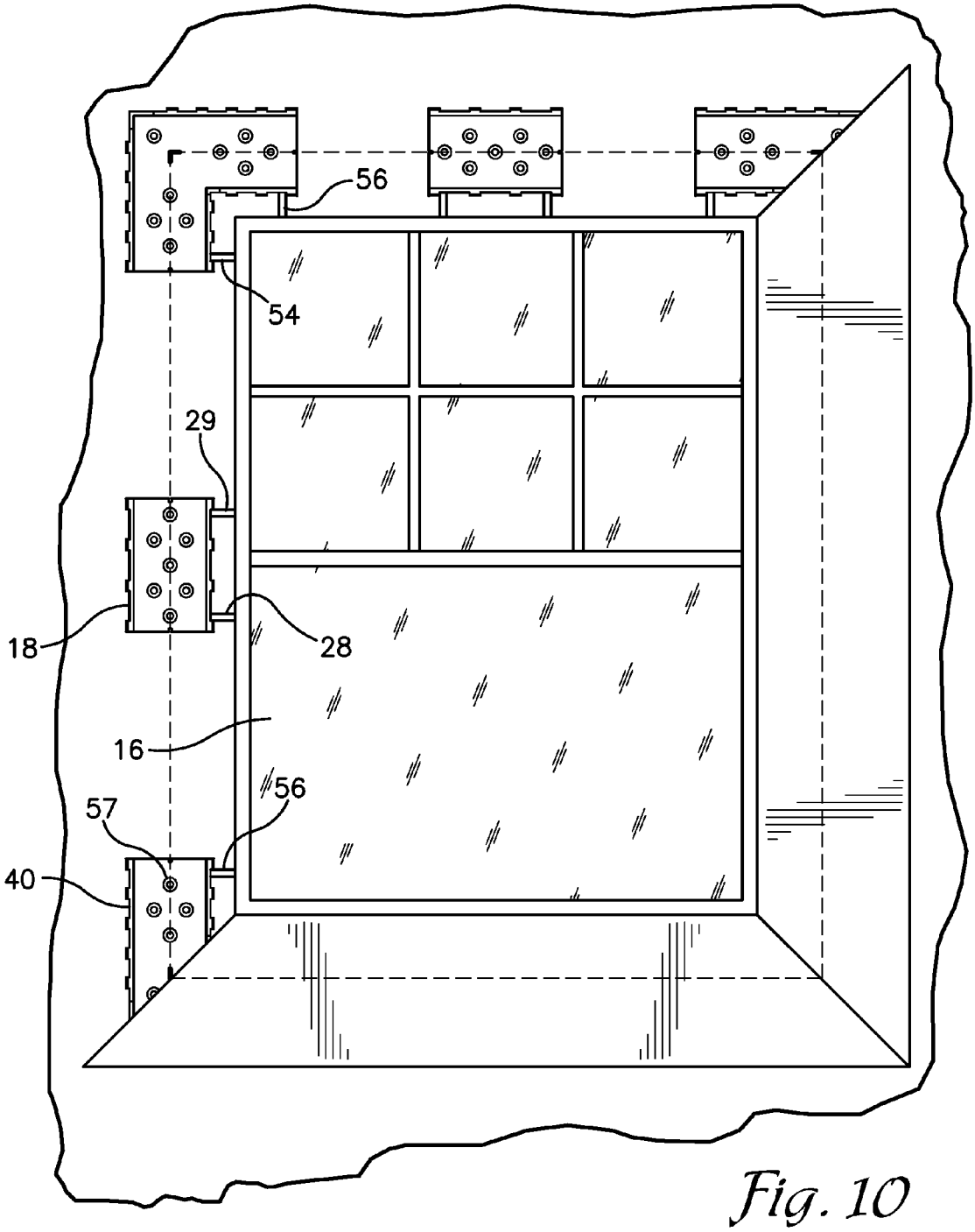
FIG. 10 is an alternative embodiment view of the methodology for installing the hidden brackets and the trim pieces.

FIG. 10 depicts the configuration of brackets necessary to create a trim installation such as that shown in FIG. 1 with the trim intersecting at a 45 degree angle. The configuration shown in FIG. 10 reveals the use of both the straight brackets 18 and the intersecting trim part brackets 40. As previously described, once the bracket for interesting trim parts 40 and straight brackets 18 are located with the assistance of the tabs 28, 29, 54, 56 the brackets are secured to the building with fasteners. The trim pieces are then snapped into position onto the brackets to form the desired 45 degree angle at the corners of the trim.

Once the trim pieces 10 are installed the siding may be installed as previously discussed by terminating the edge of the siding under the overhang 76 and over the weather strip 80 should the embodiment utilizing the weather strip be utilized. The flexible seal 92, 96 is preferably inserted into the trim cutout 90 prior to securing the trim piece 10 to the bracket. Importantly, all of these various referenced embodiments can be installed without the need for visible means for securing the trim to the building exterior. The principal attribute of this system being that no follow up work is required to fill holes in the surface of the trim 10 as the holes can detract from the appeal of the trim and fillers may be expunged from the nail or screw holes due to exposure to extreme temperatures and moisture.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

It will be understood that certain features and subcombinations are of utility and may be employed without reference to other features and subcombinations and are contemplated within the scope of the claims. Not all steps listed in the various figures need be carried out in the specific order described.

I claim:

1. A method for securing trim board around a building penetration with hidden brackets comprising the steps of:

(a) providing a bracket system for securing trim adjacent a building penetration, the bracket system comprising:
  (i) a bracket comprising a center channel, the center channel having at least one through hole and opposed first and second side was each having a proximal end and a distal end;
  (ii) at least one locking wedge located along a length of, and proximate to, each of the first and second side walls, wherein an outwardly extending element of the locking wedge protrudes perpendicularly from the distal end of each of the side walls; and
  (iii) at least one tab extending outwardly from the proximal end of one of the first and second side walls;

(b) using the at least one outwardly extending tab to locate the bracket a specified distance away from the building penetration;

(c) passing a securing device into the building through the center channel through the at least one hole;

(d) providing a trim board for placement over the bracket system, the trim board comprising:

(i) at least one trim piece that is attachable to the bracket, the trim piece including a face surface, a hidden surface, a surface facing the penetration and a surface facing away from the penetration; and (ii) at least two longitudinally extending slots disposed within the hidden surface of the trim for receiving the at least one locking wedge located along each of the first and second opposed side walls, wherein the slots are laterally disposed away from an edge of the surface facing the penetration and an edge of the surface facing away from the penetration;

(e) engaging the at least one locking wedge located along each of the opposed side walls of the bracket comprising the at least two longitudinally extending slots disposed within the hidden surface of the trim.

2. The method of claim 1, wherein the trim piece includes a flexible weatherproofing membrane extending outwardly from an edge facing away from the penetration on the trim piece hidden surface for placement under siding positioned adjacent the trim.

3. The method of claim 1, wherein the trim piece edge of the surface facing the penetration includes a cutout for retaining a flexible seal for placement against a building feature positioned within the penetration.

4. The method of claim 3, wherein the building feature positioned within the penetration includes at least one of: (1) a window; and (2) a door.

5. The method of claim 1, wherein the tab includes a plurality of striations for offsetting the bracket from the edge of the building penetration by a specified distance.

6. The method of claim 1, wherein the at least one tab is preferably two tabs separated by about a full length of the bracket.

7. The method of claim 1, wherein the center channel includes at least one through hole.

8. The method of claim 1, wherein the center channel includes at least two sets of holes.

9. The method of claim 8, wherein the first set of through holes are disposed proximate the first sidewall and the second set of through holes are disposed proximate the second sidewall.

10. The method of claim 8, wherein the at least two sets of holes include flashing in the holes to facilitate engagement by a fastening device.

11. The method of claim 10, wherein at least one of: (1) a screw; and (2) a nail, is used to secure the bracket to the building through the second set of holes in the center channel.

12. The method of claim 1, wherein the at least one tab is frangible in at least one location.

13. A method for securing trim around a building penetration with hidden brackets comprising the steps of:

(a) providing a bracket system for securing trim adjacent a building penetration, the bracket system comprising:

(i) a bracket comprising a center channel, the center channel having at least one through hole and opposed first and second side walls;

(ii) at least one locking wedge located along each of the opposed first and second side walls, wherein an outwardly extending element of the locking wedge protrudes perpendicularly from each of the side walls; and (iii) at least one tab extending outwardly from one of the first and second side walls;

(b) using the at least one outwardly extending tab to locate the bracket a specified distance away from the building penetration;

(c) passing a securing device into the building through the center channel through the at least one hole;

(d) providing a trim kit for placement over the bracket system, the trim kit comprising:

(i) at least one trim piece that is attachable to the bracket, the trim including a face surface, a hidden surface, a surface facing the penetration and a surface facing away from the penetration;

(ii) at least one longitudinally extending slot disposed within the hidden surface of the trim for receiving the at least one locking wedge located along each of the first and second opposed side walls; and (iii) an overhang on the face directed away from the penetration whereby a side edge of a siding member can be slid beneath the overhang;

(e) engaging the at least one looking wedge located along each of the first and second opposed side walls of the bracket with the at least two longitudinally extending slots disposed within the hidden surface of the trim.

14. The method of claim 13, wherein the trim piece includes a flexible weatherproofing membrane extending outwardly from the face facing away from the penetration on the trim piece hidden surface for placement beneath a building siding panel that is positioned adjacent the trim to prevent the infiltration of water beneath the trim system.

15. The method of claim 13, wherein the trim piece face facing the penetration includes a cutout for retaining a flexible seal for placement against a building feature positioned within the penetration.

16. The method of claim 15, wherein the building feature positioned within the penetration includes at least one of: (1) a window; and (2) a door.

17. The method of claim 13, wherein the tab includes a plurality of striations for offsetting the bracket from the edge of the building penetration by a specified distance.

18. The method of claim 13, wherein the at least one tab is two tabs separated by about the a full length of the bracket.

19. The method of claim 13, wherein the center channel includes at least one through hole.

20. The method of claim 13, wherein the siding member is a siding panel secured to the exterior of the building and the siding panel edge is obscured from view by the overhang.

* * * * *